US007654413B2

(12) United States Patent
Chang

(10) Patent No.: US 7,654,413 B2
(45) Date of Patent: Feb. 2, 2010

(54) SUPPORTING DEVICE FOR PACKAGE WATER DISPENSER

(76) Inventor: Kuei-Tang Chang, No. 14, Lane 54, Lungchiuan St., Banchiau City, Taipei 220 (TW)

( * ) Notice: Subject to any disclaimer, the term of this patent is extended or adjusted under 35 U.S.C. 154(b) by 370 days.

(21) Appl. No.: 11/736,111

(22) Filed: Apr. 17, 2007

(65) Prior Publication Data

US 2008/0257910 A1 Oct. 23, 2008

(51) Int. Cl.
*B67D 1/00* (2006.01)
*B67D 5/64* (2006.01)

(52) U.S. Cl. ..... 222/58; 222/83.5; 222/160

(58) Field of Classification Search ..... 222/58, 222/83.5, 160, 163
See application file for complete search history.

(56) References Cited

U.S. PATENT DOCUMENTS 6,685,056 B1 * 2/2004 Argentieri et al. ..... 222/83.5
6,786,255 B1 * 9/2004 Lee ..... 141/351
6,813,460 B2 * 11/2004 Sudo et al. ..... 399/258
6,953,069 B2 * 10/2005 Galomb ..... 222/88
7,331,487 B2 * 2/2008 Macler et al. ..... 222/83
7,494,029 B2 * 2/2009 Orita ..... 222/105

* cited by examiner

*Primary Examiner*—Kenneth Bomberg
(74) *Attorney, Agent, or Firm*—Chun-Ming Shih

(57) ABSTRACT

A supporting device for a packaged water dispenser that is capable of supporting a water bag of packaged water includes a supporting base and a supporting tray. The bottom of the supporting base is provided with a through hole for allowing an inlet conduit protruding from the top of the water dispenser to penetrate therein. The periphery of the supporting base is provided with a plurality of positioning pillars. Each positioning pillar is provided with an elastic element. The supporting tray is accommodated in the supporting base. The bottom of the supporting tray is formed into a funnel and provided with a penetrating hole to correspond to the position of the through hole. The penetrating hole allows the inlet conduit to penetrate therein. The periphery of the supporting tray is provided with a plurality of accommodating troughs for accommodating each positioning pillar and elastic element, so that the elastic element can support the supporting tray. Via this arrangement, the supporting tray raises the water bag of packaged water, so that the drinking water within the water bag can be concentrated and enter the water dispenser, thereby utilizing the water resource well.

10 Claims, 6 Drawing Sheets

SUPPORTING DEVICE FOR PACKAGE WATER DISPENSER

BACKGROUND OF THE INVENTION

1. Field of the Invention

The present invention relates to a water dispenser, and in particular to a supporting device for a water dispenser that is capable of supporting a water bag of packaged water.

2. Description of Prior Art

Since the quality of supplied running water is different from place to place, the running water has to be boiled first if a user is not sure whether he can drink the water directly or not. In order to dispense with this kind of boiling apparatus and boiling procedure, many offices or schools use bottled water or packaged water supplied by manufactures and also use an associated water dispenser having a heating device, thereby providing a good quality of water for people.

In the case of a common bottled water dispenser, since the container of bottled water is a solid container, after the container of bottled water is disposed upside down into the water dispenser, the drinking water in this container can pour into the water dispenser completely along the profile of the sold container without remaining any drinking water in the container. Therefore, such kind of water dispenser is simpler in design than the common water dispenser, which reduces the cost for the provider of drinking water. However, since the container of bottled water is designed to cooperate with the water dispenser, the container can be recycled and reused for the sake of cost. As a result, in addition to the expense of delivering the drinking water, the total delivery cost has to include the expense of recycling the empty bottles.

Therefore, in consideration of the delivery cost, some places use packaged water to replace the bottled water, thereby saving the expense of recycling and delivering. Furthermore, the material of the packaged water can be recycled in terms of environmental protection. Therefore, for the manufactures, not only the cost can be saved, but also a win-win effect in the environmental protection can be achieved.

Nevertheless, since the inlet conduit provided on the water dispenser is elongate so as to get into the water bag of the packaged water deeply, thereby allowing the drinking water within the water bag to flow into the water dispenser very fast. However, after the drinking water within the water bag is gradually reduced, the water level within the water bag is also gradually reduced until below the position of the inlet conduit. As a result, the remaining drinking water often cannot enter the water dispenser via the inlet conduit. Therefore, the water resource is not completely used and thus is wasted along with the recycling of the water bags. In view of this problem, it is necessary to improve the existing water dispenser to avoid the wastage of precious water resources.

SUMMARY OF THE INVENTION

In view of the above drawbacks, the present invention is to provide a supporting device for a packaged water dispenser that has a raising effect. Via the action of raising a water bag of packaged water generated by a plurality of elastic elements provided in the supporting device, the drinking water within the water bag can be concentrated and enter the water dispenser, thereby using the water resource within the water bag well.

In order to achieve the above objects, the present invention provides a supporting device for a packaged water dispenser. The supporting device includes a supporting base and a supporting tray. The bottom of the supporting base is provided with a through hole for allowing an inlet conduit protruding from the top of the water dispenser to penetrate therein. The periphery of the supporting base is provided with a plurality of positioning pillars. Each positioning pillar is provided with an elastic element. The supporting tray is accommodated in the supporting base. The bottom of the supporting tray is recessed and provided with a penetrating hole to correspond to the position of the through hole. The penetrating hole allows the inlet conduit to penetrate therein. The periphery of the supporting tray is provided with a plurality of accommodating troughs for accommodating each positioning pillar and elastic element, so that the elastic elements can support the supporting tray. Via this arrangement, the supporting tray raises the water bag of packaged water, so that the drinking water within the water bag can be concentrated and enter the water dispenser, thereby utilizing the water resource well.

DETAILED DESCRIPTION OF THE INVENTION

The technical contents of the present invention will be described with reference to the accompanying drawings.

Figure 1:
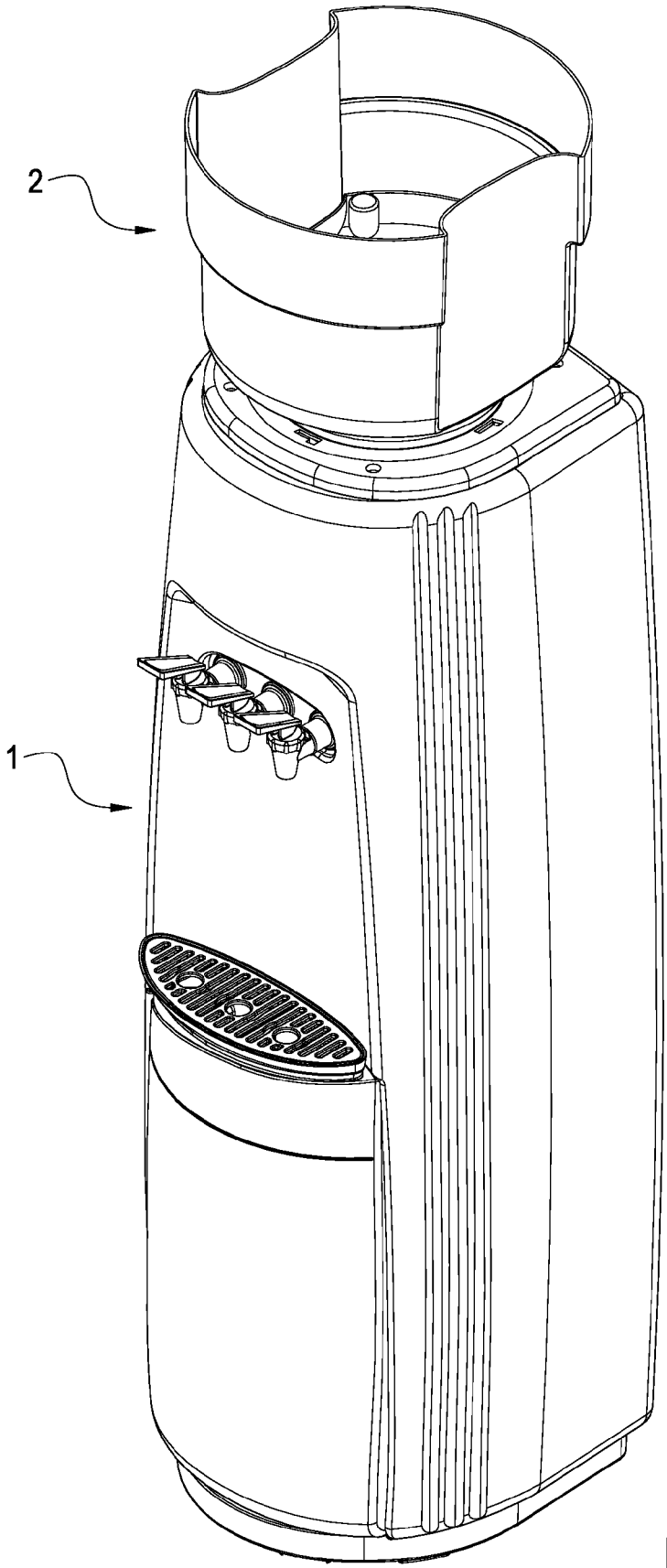
FIG. 1 is a perspective view showing the structure of the present invention.
Figure 2:
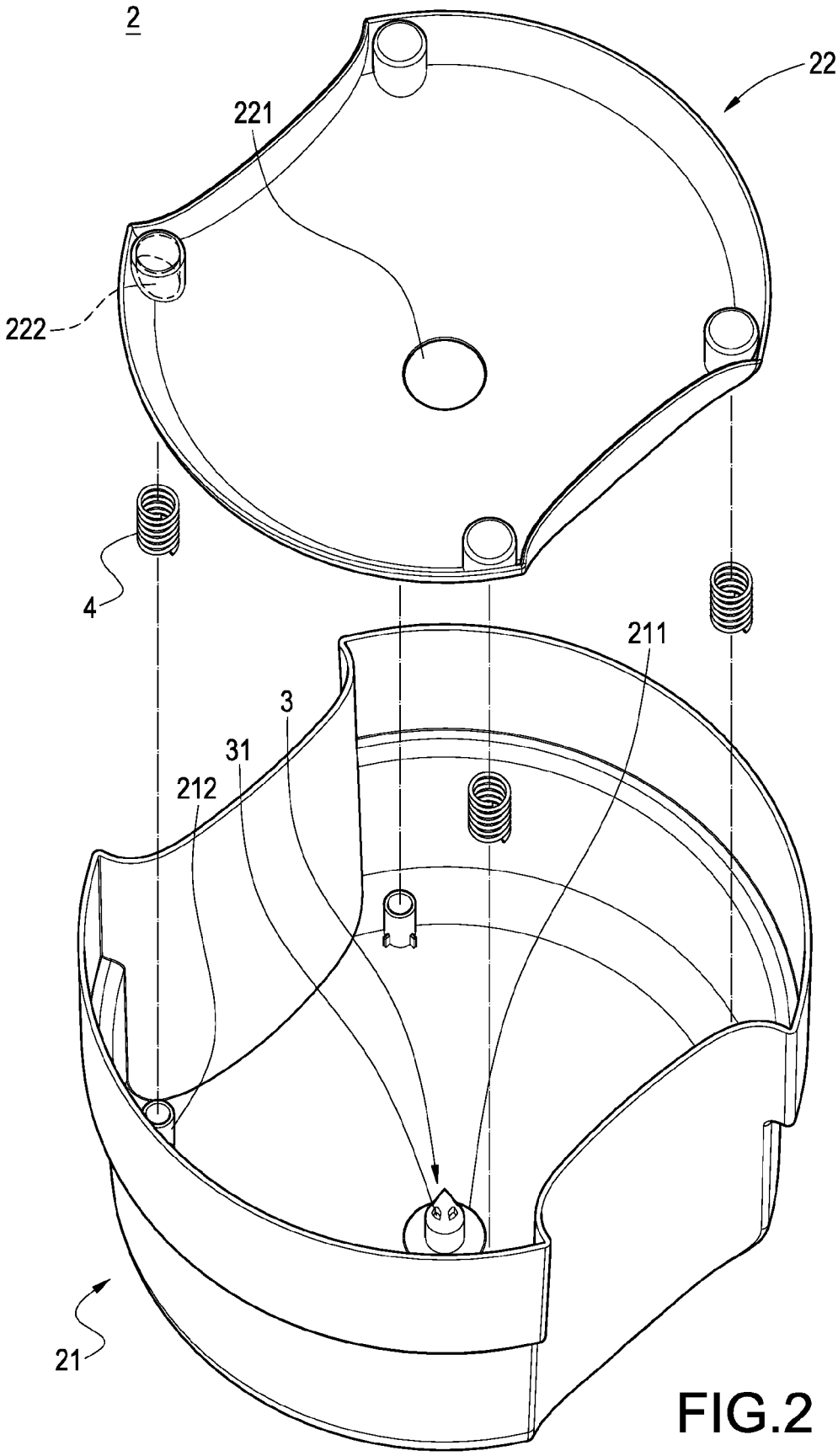
FIG. 2 is an exploded view showing the structure of the present invention.

FIG. 1 and FIG. 2 are a perspective view and an exploded view showing the structure of the present invention, respectively. As shown in FIG. 1, a water dispenser 1 is the primary body of the present invention. A supporting device 2 is provided on the top of the water dispenser 1. With reference to the exploded perspective view of FIG. 2, the supporting device 2 includes a supporting base 21. The supporting base 21 is formed into a trough. In the present embodiment, the front, rear, left and right side surfaces of the supporting base 21 are formed into curved surfaces. The front and rear side surfaces are recessed inwardly, while the left and right side surfaces extend outwardly. The bottom of the supporting base 21 is formed into a funnel. The central position of the bottom of the supporting base 21 is provided with a through hole 211 for allowing an inlet pillar 3 protruding outwardly from the top of the water dispenser 1 to penetrate therein. The inlet pillar 3 is in communication with the interior of the water dispenser 1. The periphery of the tip of the inlet pillar 3 is provided with a plurality of inlet holes 31. Furthermore, the bottom of the supporting base 21 is provided with at least one positioning pillar 212. In the present embodiment, a plurality of positioning pillars 212 is provided at corners of the bottom of the supporting base. An elastic element 4 is provided on each positioning pillar 212. In the present embodiment, the elastic element is a spring.

Figure 3:
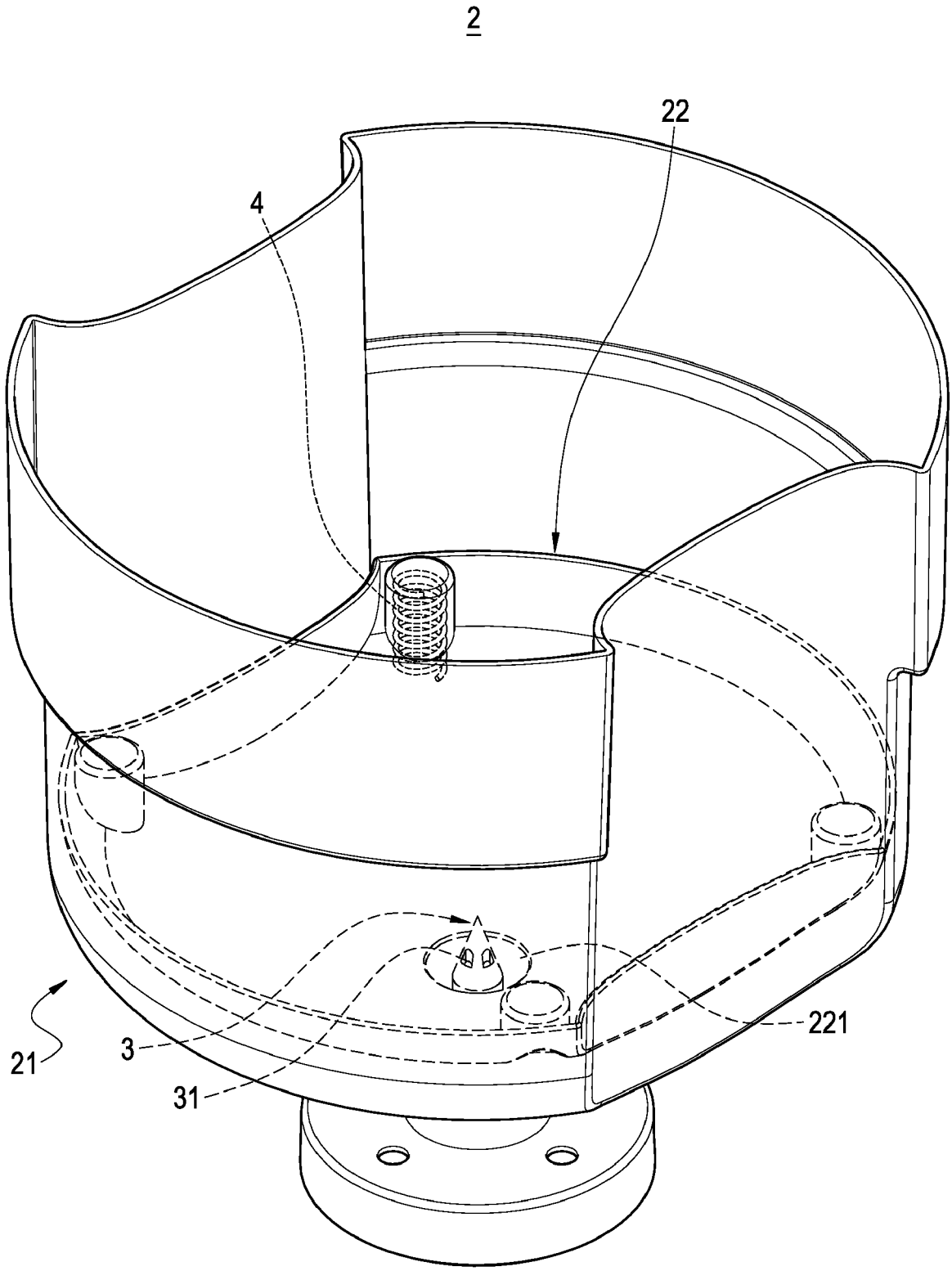
FIG. 3 is a completely assembled view showing the structure of the present invention.

With reference to FIG. 2 again, the interior of the supporting base 21 is provided with a supporting tray 22. The peripheral profile of the supporting tray 22 is substantially identical to the inner shape of the supporting base 21, so that the supporting tray 22 can be accommodated in the supporting base 21. The bottom of the supporting tray 22 is formed into a funnel. The central position of the bottom of the supporting tray 22 is provided with a penetrating hole 221 to correspond to the positions of the through hole 211 of the supporting base 21 and the inlet pillar 3. The inlet pillar 3 penetrates into the penetrating hole 221. Furthermore, the periphery of the bottom of the supporting tray 22 is provided with a plurality of accommodating troughs 222 each having an opening facing downwardly. The position of each accommodating trough 222 exactly corresponds to each positioning pillar 212, thereby accommodating each positioning pillar 212 and each elastic element 4 provided on the positioning pillar 212. The complete assembly of the present invention is shown in FIG. 3.

Figure 4:
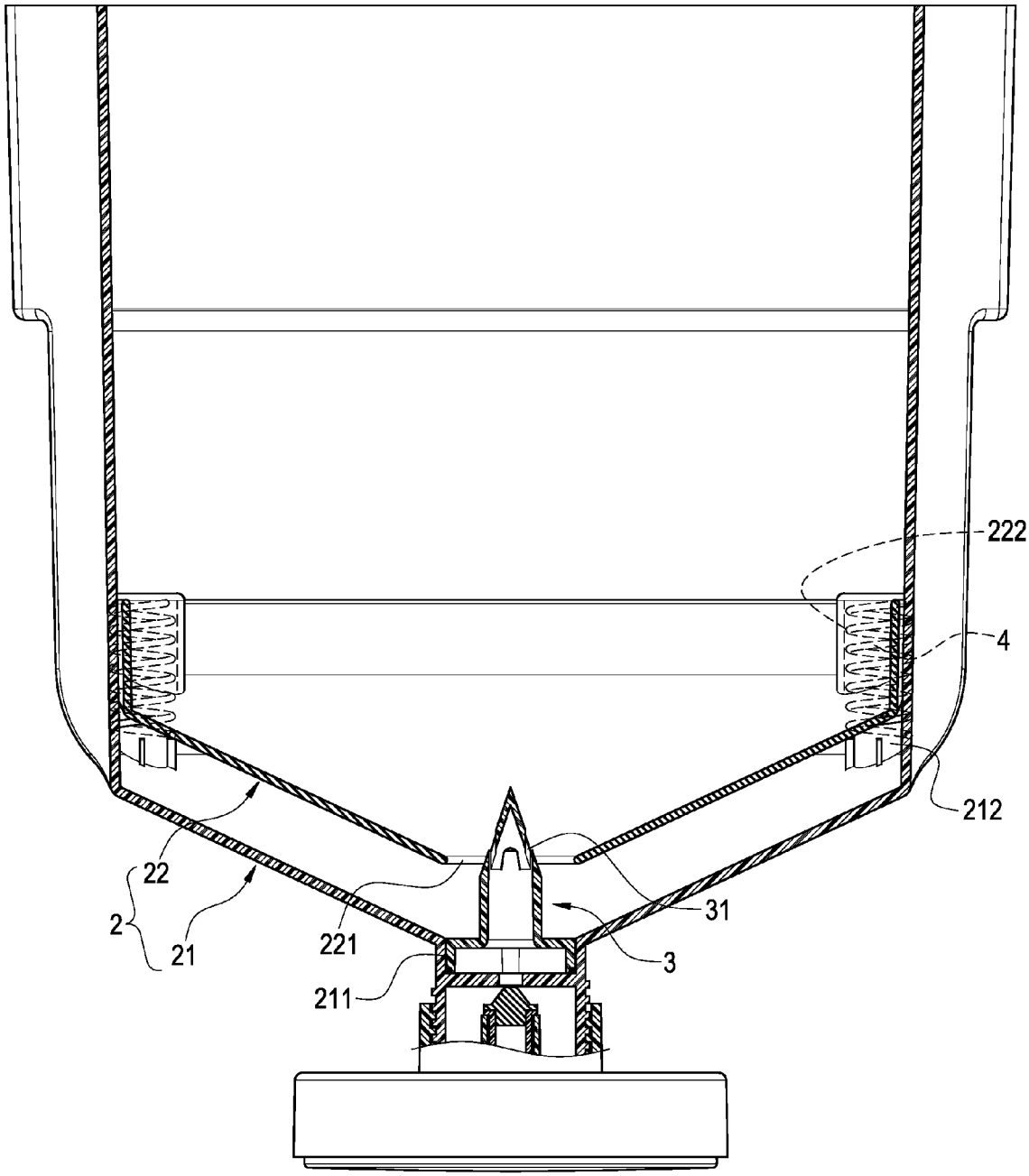
FIG. 4 is a side view showing the structure of the present invention.
Figure 5:
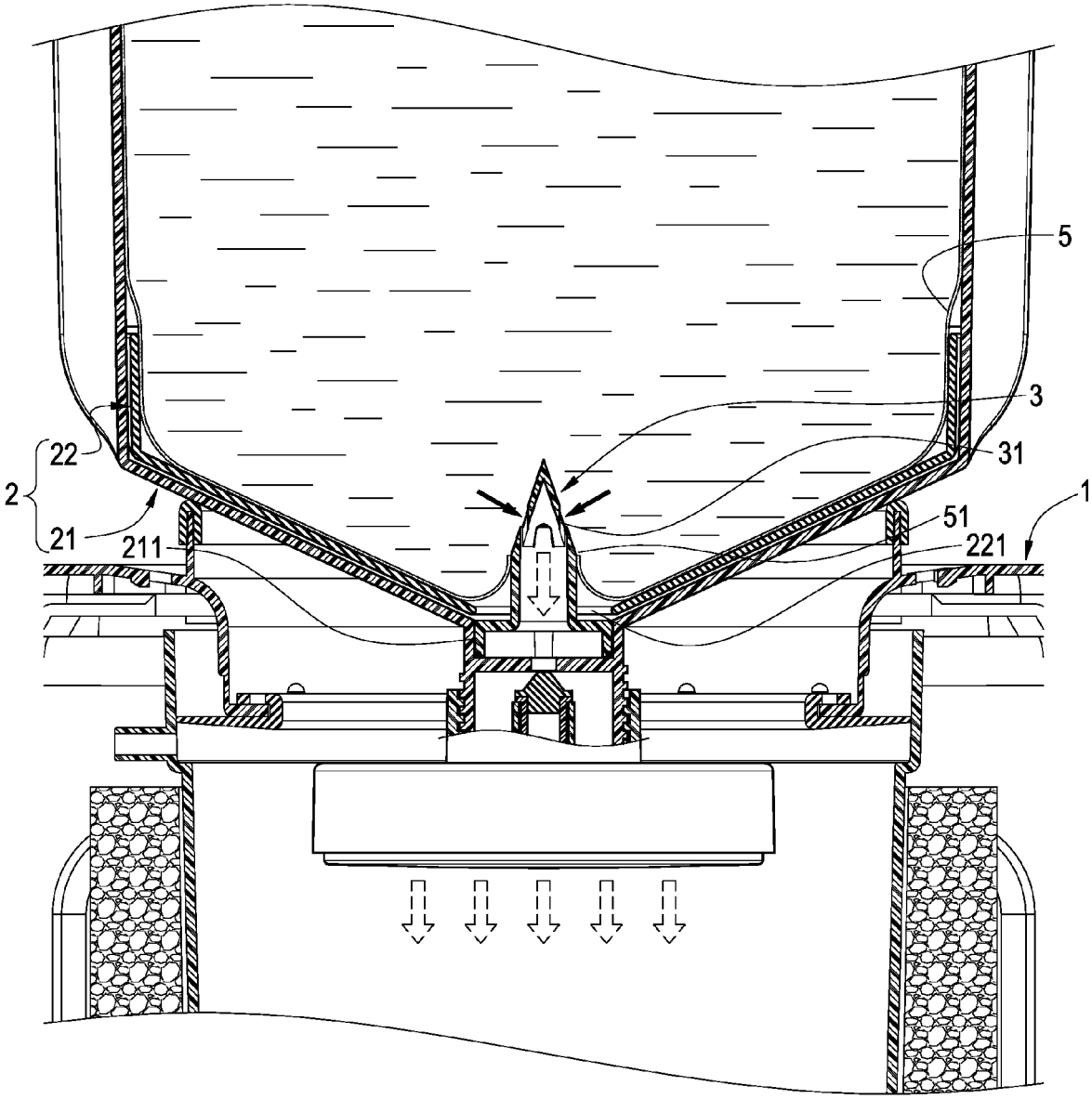
FIG. 5 is a schematic view (I) showing the operation of the present invention.
Figure 6:
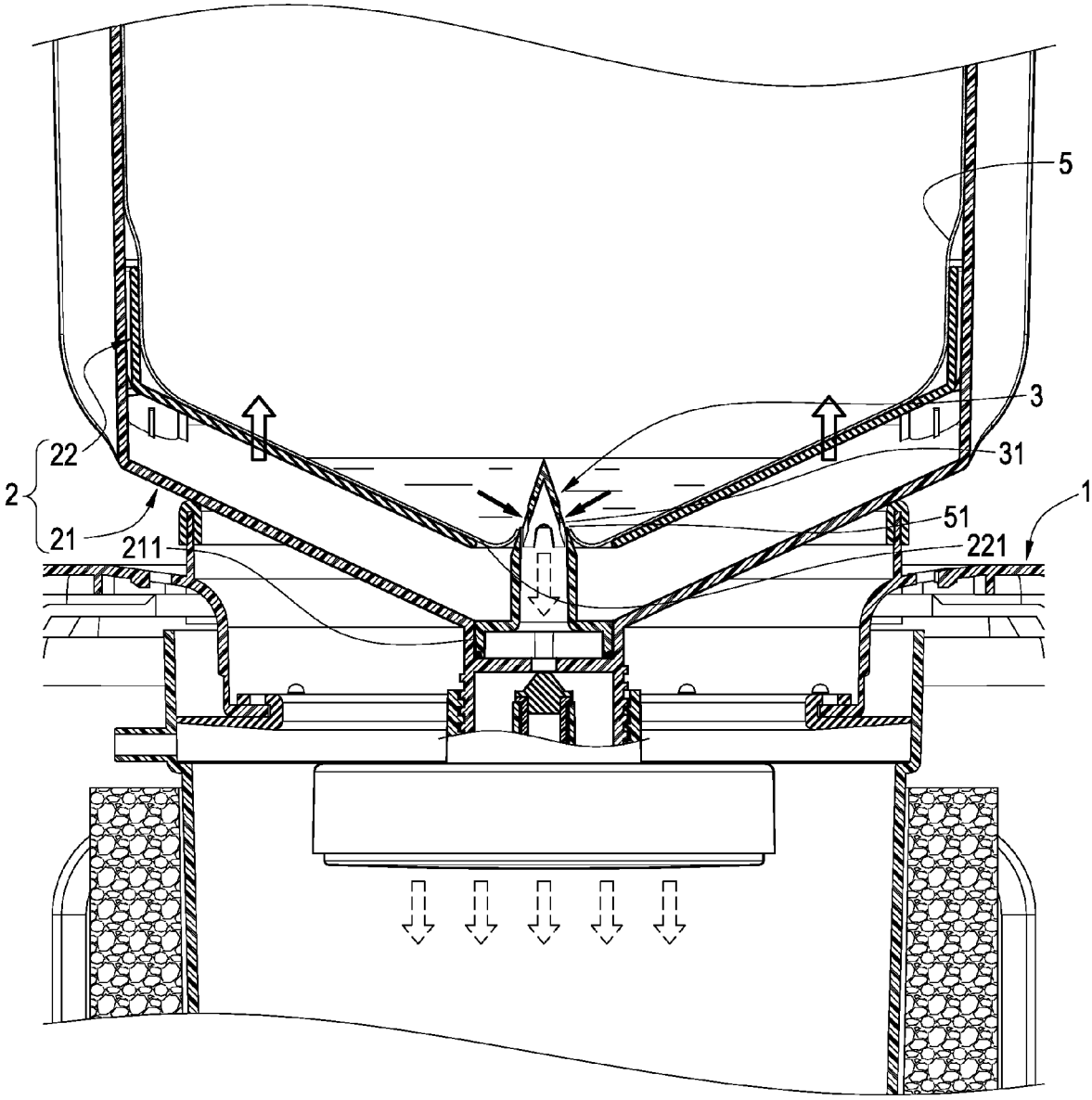
FIG. 6 is a schematic view (II) showing the operation of the present invention.

FIG. 4 is a side view showing the structure of the present invention, and FIG. 5 is a schematic view showing the operation of the present invention. After the supporting tray 22 is accommodated in the supporting base 21, the elastic force of the elastic element can support the empty supporting tray 22. The tip of the inlet conduit 3 penetrating into the penetrating hole 221 of the supporting tray 22 is exactly exposed to the bottom surface of the supporting tray 22. As shown in FIG. 5, after a water bag 5 of packaged drinking water is disposed in the supporting device 2 and a injection port 51 of the water bag 5 is aligned with the inlet conduit 3 of the water dispenser 1, the inlet holes 31 of the inlet conduit 3 can go deep into the water bag of packaged water. At the same time, the weight of the water bag 5 of the packaged water presses the supporting tray 22 downwardly. As shown in the figure, the supporting tray 22 substantially abuts against the bottom surface of the supporting base 21. When the drinking water within the water bag 5 is gradually reduced, the weight thereof will be also reduced, so that the elastic elements 4 inside the periphery of the supporting tray 22 can raise the supporting tray 22 slowly. In this way, the remaining drinking water within the water bag 5 will be concentrated and enter the water dispenser 1 via the inlet holes 31 of the inlet conduit 3. Therefore, the drinking water within the water bag 5 can enter the water dispenser 1 completely, thereby utilizing the water resources well and avoiding wastage.

Although the present invention has been described with reference to the foregoing preferred embodiment, it will be understood that the invention is not limited to the details thereof. Various equivalent variations and modifications may still occur to those skilled in this art in view of the teachings of the present invention. Thus, all such variations and equivalent modifications are also embraced within the scope of the invention as defined in the appended claims.

What is claimed is:

1. A supporting device for a packaged water dispenser, the supporting device being provided on a top of the water dispenser for supporting a water bag of the packaged water, the supporting device comprising:

a supporting base provided on a bottom thereof with a through hole and an inlet pillar of the water dispenser penetrating therethrough, the inlet pillar being provided with at least an inlet hole on a periphery of a tip of the inlet pillar;

a supporting tray accommodated in the supporting base, a bottom of the supporting tray being provided with a penetrating hole to correspond to the position of the through hole, the inlet pillar penetrating therethrough and always protruding above the bottom of the supporting tray; and at least one elastic element connected between the supporting base and the supporting tray, the elastic element being configured and arranged in the supporting device to raise the supporting tray when water within the water bag is reduced such that the remaining drinking water within the water bag will be concentrated and enter the water dispenser via the inlet hole.

2. The supporting device for a packaged water dispenser according to claim 1, wherein the elastic element is a spring.

3. The supporting device for a packaged water dispenser according to claim 1, wherein the through hole is provided in a central position of the bottom of the supporting base.

4. The supporting device for a packaged water dispenser according to claim 3, wherein the penetrating hole is provided in a central position of a bottom of the supporting tray.

5. The supporting device for a packaged water dispenser according to claim 1, wherein the supporting base is formed into a trough.

6. The supporting device for a packaged water dispenser according to claim 1, wherein the bottom of the supporting base is formed into a funnel.

7. The supporting device for a packaged water dispenser according to claim 1, wherein the bottom of the supporting tray is formed into a funnel.

8. The supporting device for a packaged water dispenser according to claim 1, wherein a periphery of the supporting base is provided with a plurality of positioning pillars.

9. The supporting device for a packaged water dispenser according to claim 8, wherein the elastic element is provided on the positioning pillars.

10. The supporting device for a packaged water dispenser according to claim 9, wherein a periphery of the supporting tray is provided with a plurality of accommodating troughs each having an opening facing downwardly, the position of each accommodating trough corresponds to that of each positioning pillar so as to accommodate simultaneously the positioning pillar and the elastic element.

* * * * *